US007913966B2

(12) United States Patent
Nordbrock

(10) Patent No.: US 7,913,966 B2
(45) Date of Patent: Mar. 29, 2011

(54) SUSPENSION ARRANGEMENT FOR A REMOVABLE FIXED LOAD SLING GEAR

(75) Inventor: Rainhard Nordbrock, Frankfurt (DE)

(73) Assignee: Rainhard Nordbrock, Frankfurt (DE)

( * ) Notice: Subject to any disclaimer, the term of this patent is extended or adjusted under 35 U.S.C. 154(b) by 28 days.

(21) Appl. No.: 12/339,456

(22) Filed: Dec. 19, 2008

(65) Prior Publication Data

US 2009/0159773 A1 Jun. 25, 2009

(30) Foreign Application Priority Data

Dec. 21, 2007 (DE) ..... 10 2007 061 349

(51) Int. Cl.
*B42F 13/00* (2006.01)

(52) U.S. Cl. ..... 248/343

(58) Field of Classification Search ..... 248/317, 248/323, 342, 343, 344, 345
See application file for complete search history.

(56) References Cited

U.S. PATENT DOCUMENTS

| | | | | | |
|---|---|---|---|---|---|
| 961,050 | A | | 6/1910 | Wakefiled | |
| 2,101,290 | A | * | 12/1937 | Pierson | 297/130 |
| 2,523,180 | A | * | 9/1950 | Anderson | 248/342 |
| 4,174,087 | A | | 11/1979 | Gaines | |
| 5,351,926 | A | * | 10/1994 | Moses | 248/354.5 |
| 2005/0139742 | A1 | * | 6/2005 | Frisell | 248/317 |
| 2006/0266908 | A1 | * | 11/2006 | Tong | 248/339 |
| 2008/0135710 | A1 | * | 6/2008 | Santa Cruz et al. | 248/327 |

FOREIGN PATENT DOCUMENTS

| | | | | | |
|---|---|---|---|---|---|
| DE | 20121118 | | 5/2002 | | |
| DE | 202006018937 | | 3/2007 | | |
| GB | 2101290 | A * | 1/1983 | | 248/343 |

* cited by examiner

*Primary Examiner* — Ramon O Ramirez
(74) *Attorney, Agent, or Firm* — Leydig, Voit & Mayer, Ltd.

(57) ABSTRACT

A suspension device for a detachably secured load-attachment means and being fixable to a supporting structure is comprised of a bearing bolt mounted to the supporting structure and defining a bearing bolt axis, at least one attachment member mounted concentrically to the bearing bolt axis, at least two adjacent arms extending radially between the bearing bolt and the at least one attachment member and connecting the bearing bolt to a first attachment member, and a cutout disposed between each of the at least two adjacent arms.

20 Claims, 6 Drawing Sheets

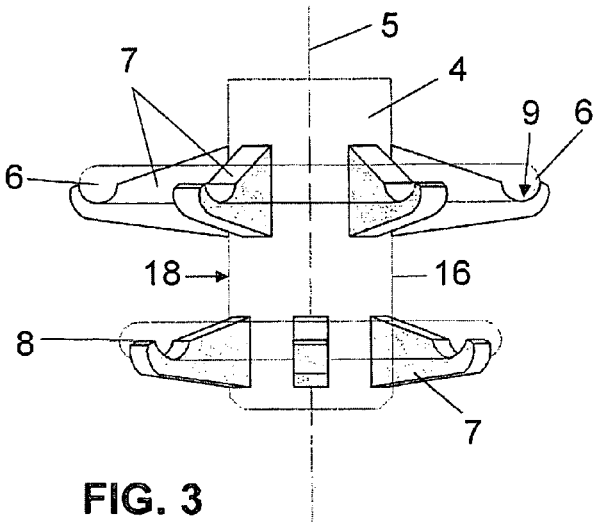
FIG. 3
FIG. 4a
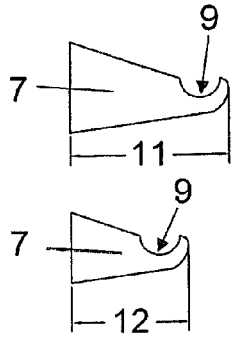
FIG. 4b
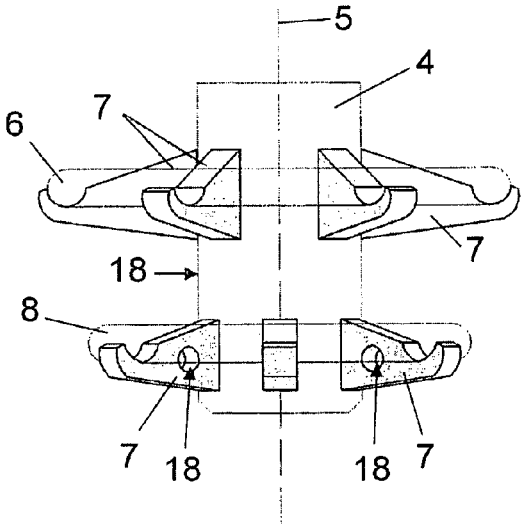
FIG. 5
FIG. 6a
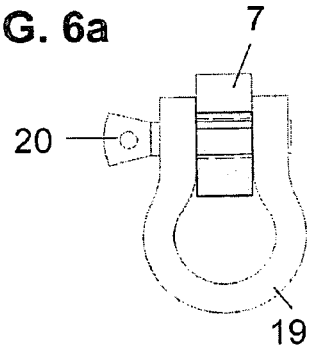
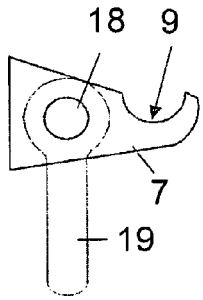
FIG. 6b FIG. 7a
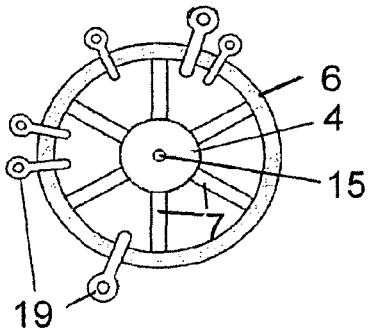
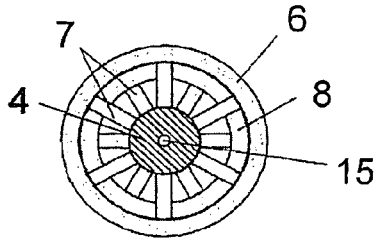
FIG.7c
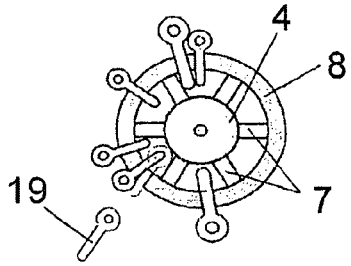
FIG. 7b
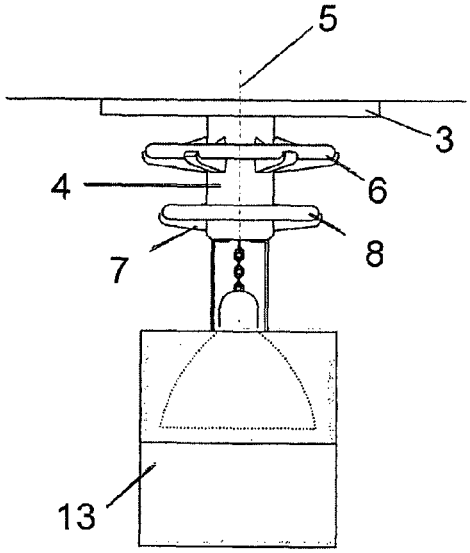
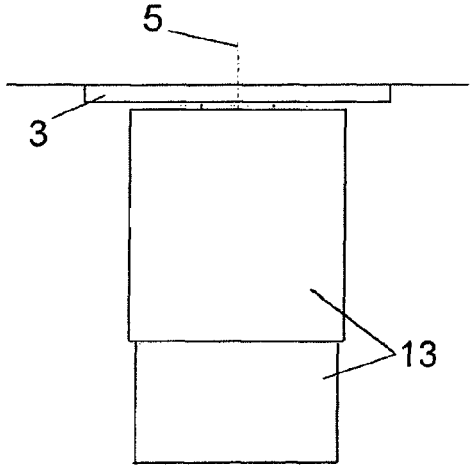
FIG. 8a FIG. 8b

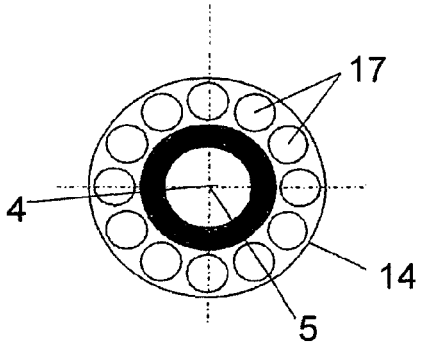
FIG. 9a
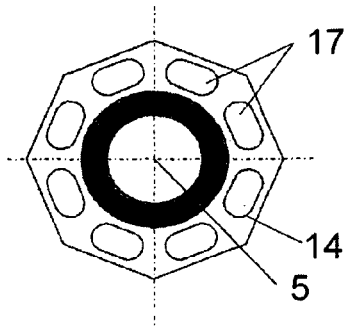
FIG. 9b
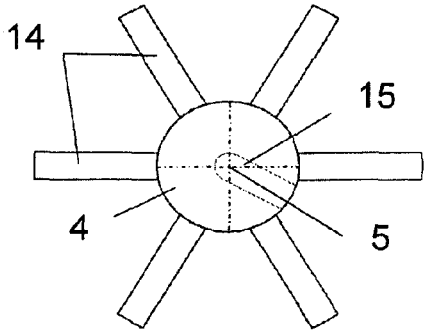
FIG. 9c
FIG. 9d
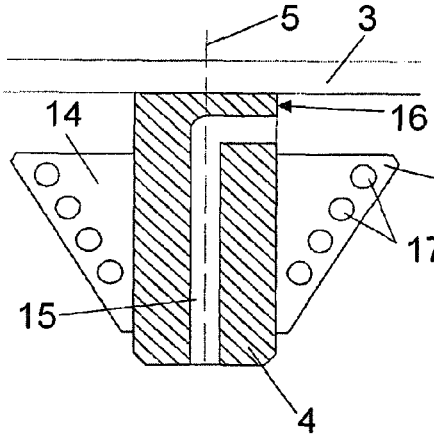
FIG. 9e
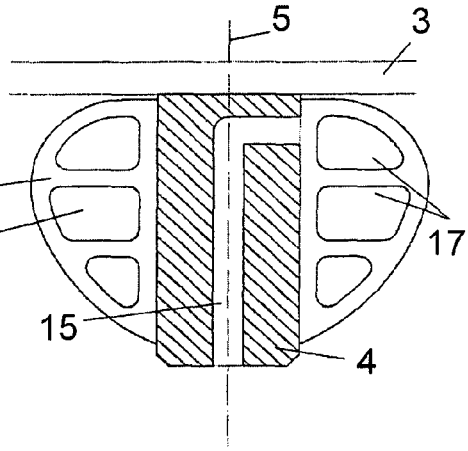

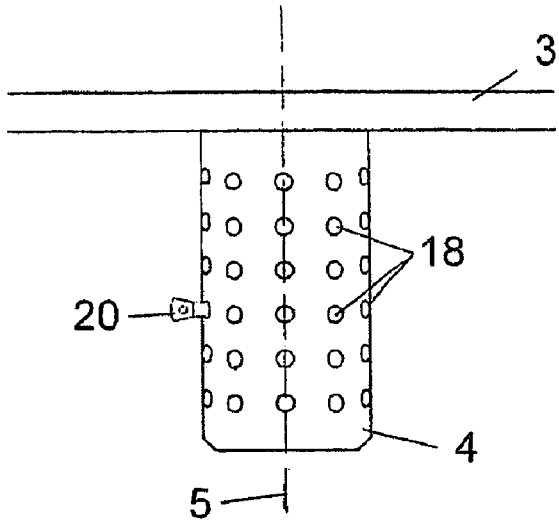
FIG. 9 f
FIG. 9g
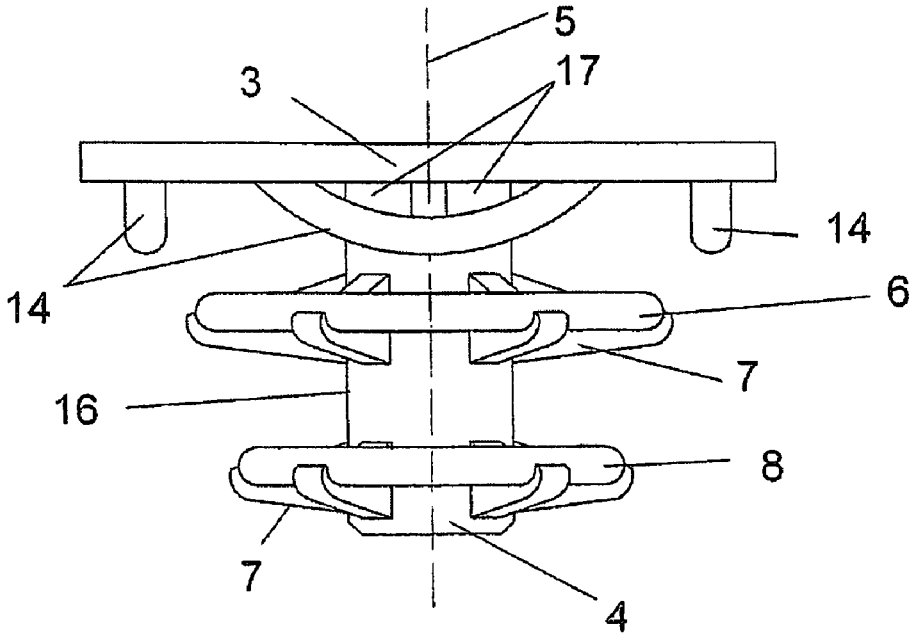

SUSPENSION ARRANGEMENT FOR A REMOVABLE FIXED LOAD SLING GEAR

Priority is claimed to German Patent DE No. 10 2007 061 349.2 filed on Dec. 21, 2007, the entire disclosure of which is incorporated by reference herein.

The present invention relates to a suspension device for a detachably secured load-attachment means. The suspension device is particularly suited for attachment to supporting structures, such as buildings, ceilings, walls, space frames, grid structures, etc.

BACKGROUND

A suspension device of this kind is known from DE 20 2006 018 937 U1. The suspension device disclosed therein is adapted to be mountable to a supporting structure by means of a base plate and is only suitable for attachment of panel elements. In the process, at least a first and a second panel element can be placed, at least partially, on the base plate and be secured by a holding device. The holding device includes a twist lock connection, which is designed to allow the first panel element and then the second panel element to be placed on the base plate in different positions. In the position in which the second panel element is placed, the first panel element is in a locked position. In a further position of the twist lock connection, both panel elements are in locked positions. For this purpose, the twist lock connection features a locking disk rotatably mounted perpendicular to the centerline.

This embodiment is limited to the attachment of panel elements (load to be attached). Moreover, such a suspension device is limited to detachable attachment at fixed points of the supporting structure which must coincide with the points at which the panel elements to be attached meet. If the panel elements do not coincide with the fixed points of the suspension devices, then an additional cross-structure is required.

SUMMARY OF THE INVENTION

It is an aspect of the present invention to provide a suspension device of the type mentioned at the outset which is versatile and simple in construction.

A first advantage is provided by the plurality of degrees of freedom which the suspension device may have in a circumferential direction and perpendicular to the circumference, and to which load-attachment means can be detachably secured. Starting at a predetermined, fixed point of attachment, preferably at grid points of a supporting structure, at least one, preferably a plurality of load-attachment means can be detachably secured to attachment members in a circumferential direction and, if needed, at least one additional load-attachment means can be detachably secured to attachment members in a direction perpendicular to the circumferential direction, for example, in a plumb direction. Preferably, a plurality of load-attachment means can be arranged in a circumferential direction and/or in a direction perpendicular to the circumferential direction, and also at different angles.

A second advantage to be mentioned is that the suspension device is also suited for loads to be attached whose fixing options do not coincide with the fixed points of the supporting structure which are intended for the suspension device. Additional substructures, such as the cross-structures used heretofore, are not needed here.

A third advantage is that apart from the load to be attached, the suspension device can be combined with additional devices. In a first refinement, the suspension device may receive at least one electrical line, for example for the lighting of a hall, and/or a loudspeaker system and/or a camera and/or a smoke detector. In a second refinement, the suspension device may receive at least one line for a fluid in a gaseous or liquid state, for example for a sprinkler system. The suspension device may also include a combination of several refinements.

A fourth advantage to be mentioned is that the suspension device may have a covering.

In a first variant, the covering may be arranged such that it is concealed over the essential elements of the suspension device, while in a second embodiment, the covering may be movable and preferably uncover these elements to allow attachment of the load-receiving means. The first variant is particularly suited for suspension devices which are preferably permanently mounted to a supporting structure, but currently not used for holding load-attachment means. Preferably, the covering can be removed in such a way that the attachment members are sufficiently accessible to allow attachment of the load-receiving means.

A fifth advantage to be mentioned is that one or more suspension devices can remain permanently at the predetermined, fixed points, preferably at grid points of a supporting structure, so that the effort for installation and removal can be significantly reduced. Then, only the load-attachment means have to be secured to or removed from the respective suspension device as needed. Thus, the suspension device, or a plurality of suspension devices, can form a unit with the supporting structure. Moreover, a plurality of suspension devices constructed in accordance with the present invention can be mounted spaced apart to a supporting structure and used for detachably securing individual or several load-attachment means thereto.

BRIEF DESCRIPTION OF THE DRAWINGS

The present invention will now be described in greater detail with reference to an exemplary embodiment and the accompanying schematic drawings, in which:

FIG. 3 shows the suspension device together with special arms;

FIGS. 4*a, b* illustrate details of the arms;

FIG. 5 illustrates further details of the arms;

FIGS. 6*a, b* are front and side views of an arm according to FIG. 5;

FIG. 7*a-c* are top views of the attachment member and the arms;

FIGS. 8*a, b* show the suspension device and the covering;

FIGS. 9*a-c* are top views of attachment members which are mounted directly to the bearing bolt;

FIG. 9*d, e* are cross-sectional views showing attachment members which are mounted directly to the bearing bolt;

FIG. 9*f* depicts an embodiment of the bearing bolt;

FIG. 9*g* shows a suspension device along with various attachment members.

DETAILED DESCRIPTION OF THE DRAWINGS

Figure 1:
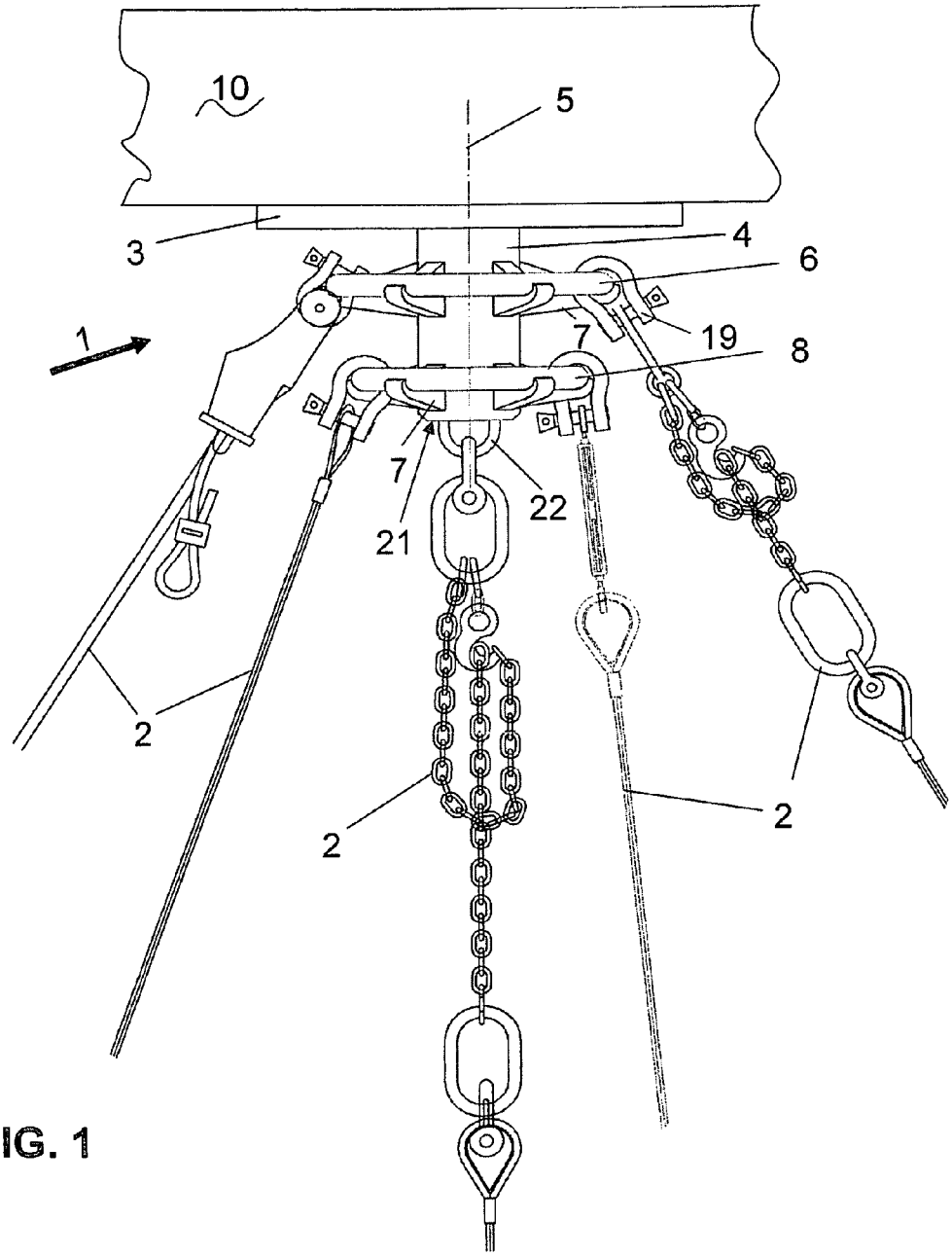
FIG. 1 shows a suspension device along with two attachment members and load-attachment means.

At least one suspension device 1 is preferably detachably fixed to a supporting structure 10, for example the ceiling of a trade show hall, at least one fixed point of attachment, which is preferably predetermined in accordance with load-bearing criteria. Suspension device 1 is preferably mounted to a grid point of supporting structure 10 (FIG. 1).

Supporting structure 10 has mounted thereto, preferably detachably fixed thereto, at least one bearing bolt 4. At least one first attachment member 6 is disposed concentrically to axis 5 of bearing bolt 4. At least two (preferably more) arms 7 extend between bearing bolt 4 and first attachment member 6 in radial directions relative to axis 5, connecting bearing bolt 4 to first attachment member 6, and a cutout 17 is provided between each two adjacent arms 7 to provide a clearance for load-attachment means 2.

Bearing bolt 4 is preferably detachably joined to supporting structure 10 at one of its side faces (in FIG. 1 at one of its end faces). Preferably, an end face (alternatively a lateral face) of bearing bolt 4 is connected to supporting structure 10.

Alternatively, an attachment member 14 (hereinafter referred to as third attachment member 14) may be mounted directly to bearing bolt 4 and have at least one cutout 17, preferably a plurality of cutouts 17, arranged concentrically to axis 5 of bearing bolt 4. In this embodiment, attachment member 14 is preferably in the shape of a plate having formed therein at least one cutout 17 or the plurality of cutouts 17. Alternatively, attachment member 14 may include a plurality of plates mounted directly to bearing bolt 4 and provided with cutouts 17. Attachment member 14 may be arranged singly or in multiples—with respect to axis 5—in a circumferential direction with a radial extent (FIG. 9*a*, FIG. 9*b*). Alternatively, at least one attachment member 14 may be mounted to bearing bolt 4 in a direction parallel to axis 5. In FIG. 9*c-e*, a plurality of such attachment members 14 are provided. FIG. 9*c*, for example, shows six attachment members 14, each spaced about 60 degrees from each other and mounted to axis 5.

In another variant, bearing bolt 4 may be permanently joined to a base plate 3, and base plate 3 is preferably detachably joined to supporting structure 10. Base plate 3 can be detachably joined to supporting structure 10, for example, by threaded connections.

Suspension device 1 is designed for the attachment of at least one, preferably a plurality of load-attachment means 2, in particular chains, connecting bars, etc. and associated connecting means, such as shackles, snap hooks, etc. Bearing bolt 4 is preferably permanently mounted to base plate 3 by one end at a side face. Preferably, this bearing bolt 4 is joined to base plate 3 at a side face by a material-to-material bond, for example, by at least one welded joint.

Figure 2:
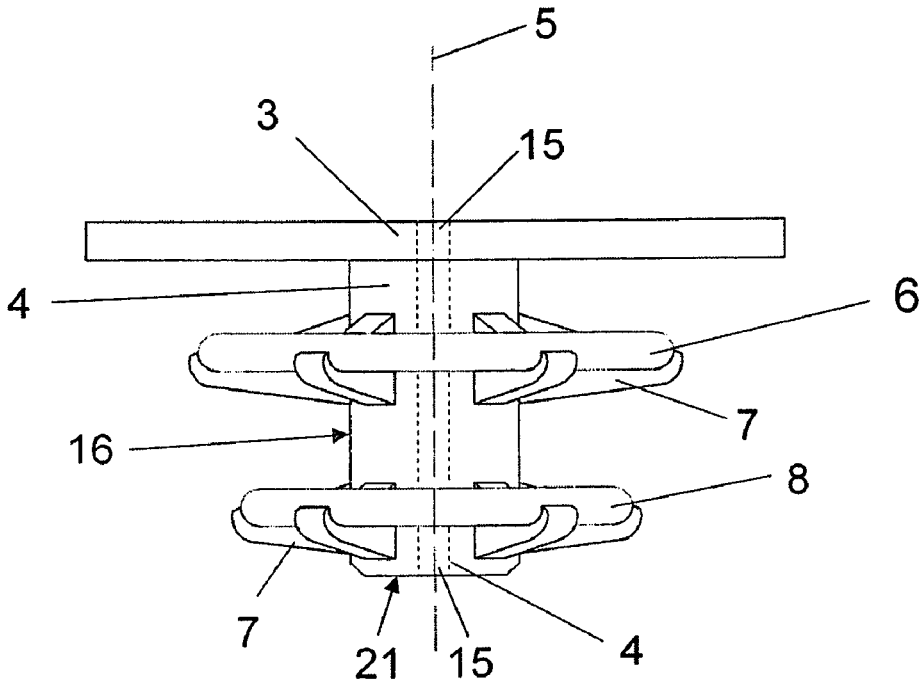
FIG. 2 illustrates the suspension device and the attachment members.

At least the one first attachment member 6 is disposed concentrically to axis 5 (longitudinal axis) of bearing bolt 4 at a distance from base plate 3 (FIG. 2).

In a first embodiment, arms 7 may extend radially between bearing bolt 4 and first attachment member 6, connecting bearing bolt 4 to first attachment member 6. Suspension device 1 includes clearances in the form of cutouts 17 provided between the spaced-apart adjacent arms 7.

In a second embodiment, at least the one third attachment member 14 may be mounted directly to bearing bolt 4 concentrically to axis 5 thereof. This attachment member 14 is made from a compact material (solid material) substantially in the shape of a plate, and has cutouts 17 formed in the material, such as bores, elongated slots, apertures, etc., (FIGS. 9*a-e*). The arms 7 of the first embodiment are not needed here. Cutouts 17 serve to receive load-attachment means 2 and, more specifically, the connecting means thereof, which are preferably secured to an end thereof, respectively. Such connecting means may include a shackle 19 and a shackle pin, or a threaded connector 20, or a safety hook, such as a snap hook.

At least one second attachment member 8 (and further attachment members, if needed) may be disposed at a distance from first attachment member 6 in the direction of axis 5 of bearing bolt 4. Similar to first attachment member 6, this second attachment member 8 may include a plurality of arms 7 and cutouts 17; i.e., arms 7 extending radially between bearing bolt 4 and second attachment member 8, connecting bearing bolt 4 to attachment member 8. More specifically, at least two arms 7 are arranged such that they extend radially, connecting bearing bolt 4 to second attachment member 8, and a cutout 17 is provided between each two adjacent arms 7.

Alternatively, an attachment member which resembles in shape to third attachment member 14 and is made of a substantially plate-shaped material and has at least one cutout 17 (but no arms 7) may be mounted directly to bearing bolt 4 in place of second attachment member 8 (or first attachment member 6) provided with arms 7. Preferably, a plurality of cutouts 17 may be arranged concentrically to axis 5 of bearing bolt 4.

Consequently, suspension device 1 is not limited to the combination of first and second attachment members 6, 8. Rather, first or second attachment members 6,8 may be combined with at least one of third attachment members 14. Depending on the dimensions of bearing bolt 4, a plurality of attachment members 6, 8, 14 extending radially and/or parallel with respect to axis 5 can be combined in many ways.

Preferably, the at least one attachment member 6, 8, 14 is arranged circularly or elliptically or polygonally concentric to axis 5 of bearing bolt 4. Preferably, the respective bearing bolt 4 is made of a solid or a hollow (sleeve-shaped) material. In the latter embodiment, a free end 21 of bearing bolt 4 is preferably closed by a cap. An outer contour 16 of bearing bolt 4 is preferably circular or elliptical or polygonal in shape. Depending on the outer contour 16 selected, the shape of the respective attachment members 6, 8, or alternatively 14, may be correspondingly configured to be circularly or elliptically or polygonally concentric to axis 5 of bearing bolt 4. Thus, for example, any shape that may be derived from the shapes mentioned above is possible, such as a sector of a circle, or a segment of a circle. Therefore, suspension device 1 is not limited to an extent of 360 degrees of attachment members 6, 8, 14 with respect to axis 5. Rather, suspension device 1 may be adapted to the construction of the supporting structure, so that such a suspension device 1 may, for example, be integrated into a 90 degree or 270 degree corner of a supporting structure 10.

In another embodiment, the respective attachment member (s) 6 and/or 8 may have arms 7 having a recess 9. Recesses 9 are preferably used to support the respective attachment member(s) 6 and/or 8 therein. For example, attachment members 6, 8 may be supported in recesses 9 in a ring-shaped, elliptical or polygonal configuration. Preferably, attachment members 6, 8 are joined to arms 7 in the region of recesses 9 by a material-to-material bond, such as by welded or adhesive connections (FIG. 3; FIG. 5).

In a further embodiment, arms 7 may, in addition, be provided with bores 18 (through holes, threaded holes, blind holes) to receive load-attachment means 2 and, more specifically, the connecting means thereof. For example, a shackle 19 may be received in through hole 18 by means of a threaded connector 20 (FIG. 5; FIGS. 6*a, b*). Shackle 19 is then connected to load-attachment means 2 (not shown).

Each arm 7 of first attachment member 6 has a first longitudinal extension 11, and each arm 7 of second attachment member 8 preferably has a second longitudinal extension 12 that is different from first longitudinal extension 11 (FIGS.

4*a, b*). Alternatively, longitudinal extensions 11, 12 may be equal in all attachment members 6, 8.

In yet another embodiment, each arm 7 of first attachment member 6 may be out of alignment with the respective adjacent arm 7 of second attachment member 8, as viewed in the direction of axis 5; i.e., the arms do not coincide in position when viewed from above (FIG. 7*c*). Alternatively, arms 7 of attachment members 6, 8 may also be in alignment and coincident with each other. Each arm 7 of first attachment member 6 may be in alignment or offset from alignment with the respective adjacent arm 7 of second attachment member 8, as viewed in the direction of axis 5. In the latter embodiment, where arms 7 are offset from each other, the clearance obtained in this manner can be optimally used for load-attachment means 2.

Suspension device 1 is not limited to the attachment members 6, 8 described above. For example, third and further attachment members could be mounted to bearing bolt 4 spaced apart from each other in the direction of axis 5, provided bearing bolt 4 is configured for this purpose. In addition, the free end 21 of bearing bolt 4 may have secured thereto at least one suspension means, such as a suspension lug or a further attachment member having cutouts 17.

A covering 13 may be arranged concentrically to the attachment member(s) 6, 8 disposed on arms 7 or attachment member 14 (without arms 7) in the direction of axis 5 of bearing bolt 4 so as to enclose attachment members 6, 8, 14. For example, a covering 13 may be attached to base plate 3. Depending on the number of attachment members 6, 8, 14, said covering 13 is concentric to attachment members 6, 8, 14 in the direction of axis 5 of bearing bolt 4. Thus, suspension device 1 may be substantially covered as needed. In a first variant, the essential elements of suspension device 1 are covered, while in a second variant, these elements are preferably uncovered for attachment of load-receiving means 2.

Preferably, covering 13 is capable of telescoping; i.e., capable of being retracted and extended, along axis 5 (double arrow in FIGS. 8*a, b*). Preferably, covering 13 may be changeable in position at the end opposite supporting structure 10. Covering 13 is preferably configured such that attachment members 6, 8, 14 can be, at least partially, uncovered to allow attachment of load-attachment means 2. The remaining parts of suspension device 1 may remain covered.

In a further embodiment, bearing bolt 4 may include at least one cavity 15 extending in the direction of axis 5. A cavity 15 may be provided already during the manufacture of bearing bolt 4, namely in the form of an inner space of a sleeve, or in the form of at least one bore formed in the material of bearing bolt 4. Preferably, at least one supply line is disposed within such a cavity 15. Cavity 15 may, in addition, extend along an angled path relative to axis 5 and merge into outer contour 16 of bearing bolt 4 (FIGS. 9*d, e*). Thus, suspension device 1 may receive, especially in its cavity 15, at least one electrical line, for example for the lighting of a hall, and/or a loudspeaker system and/or a camera and/or a smoke detector. In a second refinement, suspension device 1 may receive, especially in its cavity 15, at least one line for a fluid, for example for a sprinkler system. Suspension device 1 may also include a combination of several refinements.

The mode of operation of suspension device 1 is as follows: Once the at least one suspension device 1 is fixed to supporting structure 10, load-attachment means 2 are attached to the respective attachment members 6, 8 (or other attachment members). This is done, for example, using shackles 19, which are functionally connected to load-attachment means 2, said shackles being placed in cutouts 17 and detachably connected to the respective attachment member 6, 8, 14. For example, in the case of an attachment member 6, 8 having a ring-shaped design, shackle 19 grips around the ring of attachment member 6, 8 in the region of a cutout 17 (FIG. 1, FIGS. 7*a, b*). In the case of an attachment member 14 having a substantially plate-shaped configuration, such as is shown in FIGS. 9*a-e*, shackle 19 grips around the outer edge of the solid material in the region of a cutout 17 (not shown).

Suspension device 1 is not limited to the embodiments described herein. Rather, in a simple embodiment, a base plate 3 may be mounted to supporting structure 10. At least one attachment member 14 is mounted to base plate 3, and at least one cutout 17 is provided between base plate 3 and each attachment member 14, or a plurality of cutouts 17 is provided in attachment member 14 itself. One such embodiment is shown in FIG. 9*g*. Here, attachment members 14 are curved circularly or elliptically or polygonally and are provided with a cutout 17 between the curvature and base plate 3 to allow attachment of load-attachment means 2. FIG. 9*e* shows optionally, in addition, a known bearing bolt 4 including the associated attachment members 6, 8, and, if needed, also attachment members 14 extending parallel to axis 5.

Another embodiment is shown in FIG. 9*f*, where a bearing bolt 4 is provided with at least one bore 18 in its outer circumferential contour 16. Bore 18 may, for example, be in the form of a threaded hole, and a threaded connector 20 may be removably fixed in this bore 18. Threaded connector 20 may be provided with a bore for detachably securing, for example, lighter load-receiving means 2. Optionally, at least one of attachment members 6, 8, 14 may be secured to this bearing bolt 4.

LIST OF REFERENCE NUMERALS

1 suspension device
2 load-attachment means
3 base plate
4 bearing bolt
5 axis (bearing bolt)
6 first attachment member
7 arm
8 second attachment member
9 recess
10 supporting structure
11 first longitudinal extension
12 second longitudinal extension
13 covering
14 third attachment member
15 cavity
16 outer contour
17 cutout
18 bore
19 shackle
20 threaded connector
21 free end
22 suspension means (suspension lug, etc)

What is claimed is:

1. A suspension device for a detachably secured load-attachment means and being fixable to a supporting structure, the suspension device comprising:

a bearing bolt mounted to the supporting structure and defining a bearing bolt axis;

a first attachment member mounted concentrically to the bearing bolt axis;

at least two adjacent arms extending radially between the bearing bolt and the first attachment member and connecting the bearing bolt to the first attachment member; and a cutout disposed between each of the at least two adjacent arms.

2. The suspension device as recited in claim 1, wherein the bearing bolt is connected at a side face of the supporting structure.

3. The suspension device as recited in claim 1, further comprising a base plate detachably joined to the supporting structure, wherein the bearing bolt is permanently joined to the base plate.

4. The suspension device as recited in claim 1, wherein the bearing bolt includes a solid material or a hollow material.

5. The suspension device as recited in claim 1, further comprising second attachment member disposed at a distance from the first attachment member in the direction of the axis of the bearing bolt, wherein at least two arms extend radially between the bearing bolt and the second attachment member, including a cutout therebetween each of the at least two arms, the at least two arms connecting the bearing bolt to the second attachment member.

6. The suspension device as recited in claim 5, wherein each of the at least two arms connecting the bearing bolt and the first attachment member have a first longitudinal extension, and each of the at least two arms connecting the bearing bolt and the second attachment member have a second longitudinal extension, wherein the first longitudinal extension is different from the second longitudinal extension.

7. The suspension device as recited in claim 5, wherein each of the at least two arms connecting the bearing bolt to the first attachment member is out of alignment with a respective spaced-apart adjacent arm of the second attachment member with respect to the bearing bolt axis.

8. The suspension device as recited in claim 5, wherein a covering is arranged concentrically to the attachment members disposed on the at least two arms in the direction of the bearing bolt axis.

9. The suspension device as recited in claim 8, wherein the covering is capable of being retracted and extended in a telescoping manner.

10. The suspension device as recited in claim 8, wherein the covering is changeable in position at the end opposite the supporting structure.

11. The suspension device as recited in claim 1, wherein the first attachment member is arranged circularly or elliptically or polygonally concentric to the bearing bolt axis.

12. The suspension device as recited in claim 1, wherein the at least two arms are provided with a recess in which the respective attachment member is disposed.

13. The suspension device as recited in claim 1, wherein at least one suspension lug is disposed on a free side face of the bearing bolt.

14. The suspension device as recited in claim 1, wherein the bearing bolt includes at least one cavity extending in the direction of the axis and having at least one supply line disposed therein.

15. The suspension device as recited in claim 14, wherein the cavity extends along an angled path relative to the axis and merges into the outer contour of the bearing bolt.

16. The suspension device as recited in claim 1, wherein the suspension device is mounted to a grid point of the supporting structure.

17. The suspension device as recited in claim 1 further comprising:

a baseplate disposed on the supporting structure;

at least one further attachment member disposed on the base plate; and at least one further cutout provided between the base plate and at least a portion of each of the at least one further attachment members.

18. A suspension device for a detachably secured load-attachment means and being fixable to a supporting structure, the suspension device comprising:

a bearing bolt mounted to the supporting structure and defining a bearing bolt axis; and at least one attachment member mounted directly to the bearing bolt having at least three cutouts arranged concentrically to the bearing bolt axis.

19. The suspension device as recited in claim 1, wherein an outer contour of the bearing bolt is circular or polygonal in shape.

20. The suspension device as recited in claim 18, wherein a second attachment member is mounted directly to the bearing bolt and has at least three cutouts arranged concentrically to the bearing bolt axis.

* * * * *